US005467095A

United States Patent [19]

Rodal et al.

[11] Patent Number: 5,467,095

[45] Date of Patent: Nov. 14, 1995

[54] LOW PROFILE ANTENNA

[76] Inventors: Eric B. Rodal, 19140 Cozsette La., Cupertino, Calif. 95014; Reed A. Parker, 12130 Mellowood Dr., Saratoga, Calif. 95027

[21] Appl. No.: 261,742

[22] Filed: Jun. 17, 1994

Related U.S. Application Data

[63] Continuation of Ser. No. 901,084, Jun. 19, 1992, abandoned.

[51] Int. Cl.[6] ..... H01Q 1/38

[52] U.S. Cl. ..... 343/700 MS; 343/846

[58] Field of Search ..... 343/700 MS, 846, 343/829, 767; H01Q 13/08, 1/38

[56] References Cited

U.S. PATENT DOCUMENTS 4,320,401 3/1982 Schiavone ..... 343/700 MS 4,771,291 9/1988 Lo et al. ..... 343/700 MS 4,907,006 3/1990 Nishikawa et al. ..... 343/700 MS 5,200,756 4/1993 Feller ..... 343/700 MS

*Primary Examiner*—Michael C. Wimer

*Attorney, Agent, or Firm*—William E. Pelton; Donald S. Dowden

[57] ABSTRACT

An antenna has a ground plane and a radiating element supported in electrically insulated, closely spaced-apart relation to the ground plane. Electrical energy is fed to the radiating element for radiation therefrom. The radiating element is constructed so as to lengthen at least one effective electrical dimension of the radiating element relative to a corresponding dimension of an orthogonal projection of the radiating element onto a plane parallel to the ground plane. In the preferred embodiment, the radiating element has a central plane portion substantially parallel to the ground plane, an outer flange portion extending towards the ground plane, and a square cutout centered with respect to the central plane portion.

5 Claims, 3 Drawing Sheets

LOW PROFILE ANTENNA

This is a continuation of application Ser. No. 07/901,084, filed Jun. 19, 1992, now abandoned.

BACKGROUND OF THE INVENTION

Cross Reference to Related Applications

This application is related to an application of Eric B. Rodal et al. Ser. No. 07/714,192, filed Jun. 12, 1991, now U.S. Pat. No. 5,173,715, and to its parent application Ser. No. 07/445,754, filed Dec. 4, 1989, now abandoned, of which the '192 application is a continuation-in-part. Both of said applications are assigned to the assignee of the present application.

Field of the Invention

This invention relates to antennas and, more particularly, to a novel, inexpensive, and highly effective antenna that has nearly constant gain over a hemisphere of solid angle so that it is essentially omnidirectional for antennas located near the surface of the earth. As will appear below, an antenna constructed in accordance with the invention is electrically larger but physically smaller than "corresponding" antennas in the prior art.

Description of the Prior Art

For certain radio transmissions, circular polarization (CP) is desirable. CP is a special case of elliptic polarization in which the horizontal and vertical (orthogonal) components are of equal magnitude and exactly 90 degrees out of phase. Most polarized signals are not perfectly circular, but have some degree of ellipticity. References herein to CP include elliptic polarization in every possible range.

Turnstile, patch, and other types of relatively inexpensive antennas are known that are semi-omnidirectional—i.e., have nearly uniform gain over the celestial hemisphere seen from a point relatively near the surface of the earth—and have respective impedances that can be matched to those of the respective circuits in which they are used. Turnstile antennas are disclosed in a book entitled "Antennas" by John D. Kraus, McGraw-Hill Book Company, second edition, 1988, pages 726–731. A typical conventional turnstile antenna 10 (FIG. 1A of the drawing of the applications cross-referenced above) comprises two dipoles 12 and 14 lying in a plane. Such an antenna is referred to hereinafter as a "planar turnstile." If the dipoles 12 and 14 are properly related to each other and properly driven and the plane defined by the dipoles 12 and 14 is horizontal, the turnstile antenna formed thereby can transmit or receive CP radiation very well at the zenith, which is directly above the antenna, but less well as the angle from the zenith increases.

Another well-known semi-omnidirectional antenna is commonly referred to as a "patch," or planar microstrip antenna. These antennas are also disclosed in the Kraus publication mentioned above (pages 745–749). With this type of antenna, the reduction in the vertical E-field component is even more pronounced, resulting in a severe loss of axial ratio for circularly-polarized signals in the plane of the horizon. A typical microstrip patch antenna is shown in FIGS. 1B, 1C and 1D of the cross-referenced applications. An example of this effect is shown in FIG. 2 of the same applications. In that figure, where the angle is defined by a line from the zenith Z to the antenna 10 and another line from the antenna 10 to a point 16 displaced from the zenith, the component of the E vector in the vertical direction is reduced; and where the angle is 90°—that is, where the angle is defined by a line from the zenith to the antenna 10 and another line from the antenna 10 to a point 18 on the horizon—, the vertical component of the E vector disappears entirely in the case of the patch and nearly so in the case of the turnstile, so that the radiation is no longer circularly polarized. Thus a conventional patch antenna and to a lesser extent a conventional turnstile antenna mounted with its base plane horizontal to achieve hemispherical omnidirectionality does not effectively radiate or receive circularly-polarized radiation to or from a region lying in a direction 90 ° from the zenith. As FIG. 2 of the cross-referenced applications shows, the vertical component of the E vector decreases to nearly zero in this region. As the angle with respect to the zenith increases, the axial ratio deteriorates markedly, so that the conventional patch and turnstile are reduced to functioning essentially as linearly-polarized antennas.

In some applications, this loss of axial ratio (or reduction from circular polarization to linear) can mean a significant loss in system performance. For example, in the case where a signal from a navigation satellite is incident at a very low elevation angle above the horizon (80° or more of off-axis angle from the zenith) on a receiver mounted on a marine vehicle, there are likely to be significant multi-path reflections from the surface of the water. When the receiving antenna is able to receive only a single, horizontally-polarized signal, it is likely that interference due to the multiple paths will induce severe fading of the signal, resulting in a loss of information. With an antenna that has good circular polarization (CP), however, the degree of fading is significantly reduced, since it is much harder to cancel out both the vertical and horizontal components with precisely the right 90-degree phase shift between the two signals. In other words, good CP vastly alleviates the problems of low look-angle reception.

Conventional patch and turnstile antennas moreover do not provide uniform gain over a solid angle of 180° of celestial arc. Essentially constant azimuthal gain in the plane of the horizon is easily achieved by using two pairs of dipole elements arranged at right angles to each other. However, such an antenna provides more gain in a direction normal to the ground plane than in a direction parallel to the ground plane. This is a disadvantage particularly on moving vehicles (boats, for example) that exhibit roll and pitch in addition to yaw and translation and that need to transmit or receive omnidirectionally over the celestial hemisphere.

For example, consider a conventional patch or turnstile antenna mounted on a boat that is moored in quiet waters or is in a yard or dry dock. For best omnidirectional transmission or reception over the celestial hemisphere, such an antenna will be mounted with its ground plane parallel to the horizon and its mast extending in a direction normal to the plane of the horizon. The gain of the antenna will then be as shown in curve A of FIG. 3 of the applications cross-referenced above: namely, it will range from a typical maximum value at the zenith, shown in FIG. 3 of those applications as +5 decibels relative to isotropics (dBi), to a greatly reduced value on the horizon, shown in the same figure as about −5 dBi.

Let it be assumed that this is satisfactory for reception of signals from, say, a navigation satellite that is anywhere above the horizon. Even on that assumption, reception of signals from a navigation satellite that is low above the horizon may be unsatisfactory at sea, where the boat is subject to roll and pitch. For example, suppose that the satellite is 90° off the starboard bow and low above the horizon while the boat rolls to port. The ground plane of the antenna, which is fixed relative to the boat, will also roll to port, thereby correspondingly reorienting the curves of FIG. 3 of the cross-referenced applications so that the antenna gain will fall from the −5 dBi it provides when the boat is level (curve A, which relates to a conventional antenna) to a value less than that, which may be insufficient for adequate transmission or reception.

The situation is made worse when two boats communicate with each other using conventional semi-omnidirectional turnstile antennas. From time to time they will roll and pitch in such a way that the antenna masts tilt away from each other. In that case, the curves relating to the transmitting antenna will be rotated, say, clockwise, while the curves for the receiving antenna will be rotated counterclockwise. Thus a signal that is weaker because of the roll and pitch of one boat has to be detected by an antenna that is less sensitive because of the roll and pitch of the other boat.

Some prior art of interest includes the following U.S. Pat. Nos. 1,988,434, 2,110,159, 2,976,534, 3,919,710, 3,922,683, 4,062,019 and 4,647,942. However, no art heretofore developed discloses an inexpensive patch antenna that has essentially constant gain over a hemisphere of solid angle so that it is semi-omnidirectional, has excellent CP near the horizon, and has an excellent VSWR.

OBJECTS AND SUMMARY OF THE INVENTION

An object of the invention is to remedy the problems outlined above. In particular, an object of the invention is to provide a novel, small, inexpensive, and highly effective antenna that has essentially constant gain over a hemisphere of solid angle so that it is semi-omnidirectional.

Another object of the invention is to provide an antenna with excellent CP over a wide range of look angles, especially near the horizon.

Another object of the invention is to provide an antenna that requires no tuning or is easily tunable without the aid of special circuit elements such as impedance-matching transformers, which are unavoidably lossy.

The foregoing and other objects are attained in accordance with the invention by the provision of an antenna comprising: means defining a ground plane; means defining a radiating element; means supporting the radiating element in electrically insulated, closely spaced-apart relation to the ground plane; and feed means for feeding electrical energy to the radiating element for radiation therefrom; the radiating element being constructed so as to lengthen at least one effective electrical dimension of the radiating element relative to a corresponding dimension of an orthogonal projection of the radiating element onto a plane parallel to the ground plane.

Preferably, the radiating element has a rectangular central plane portion substantially parallel to the ground plane and an outer portion extending towards the ground plane, and the central plane portion is formed with a square cutout.

BRIEF DESCRIPTION OF THE DRAWING

A better understanding of the objects, features and advantages of the invention can be gained from a consideration of the following detailed description of the preferred embodiments thereof, in conjunction with the appended figures of the drawing, wherein a given reference character always designates a given structure or part, and wherein.

DESCRIPTION OF THE PREFERRED EMBODIMENTS

Figure 1:
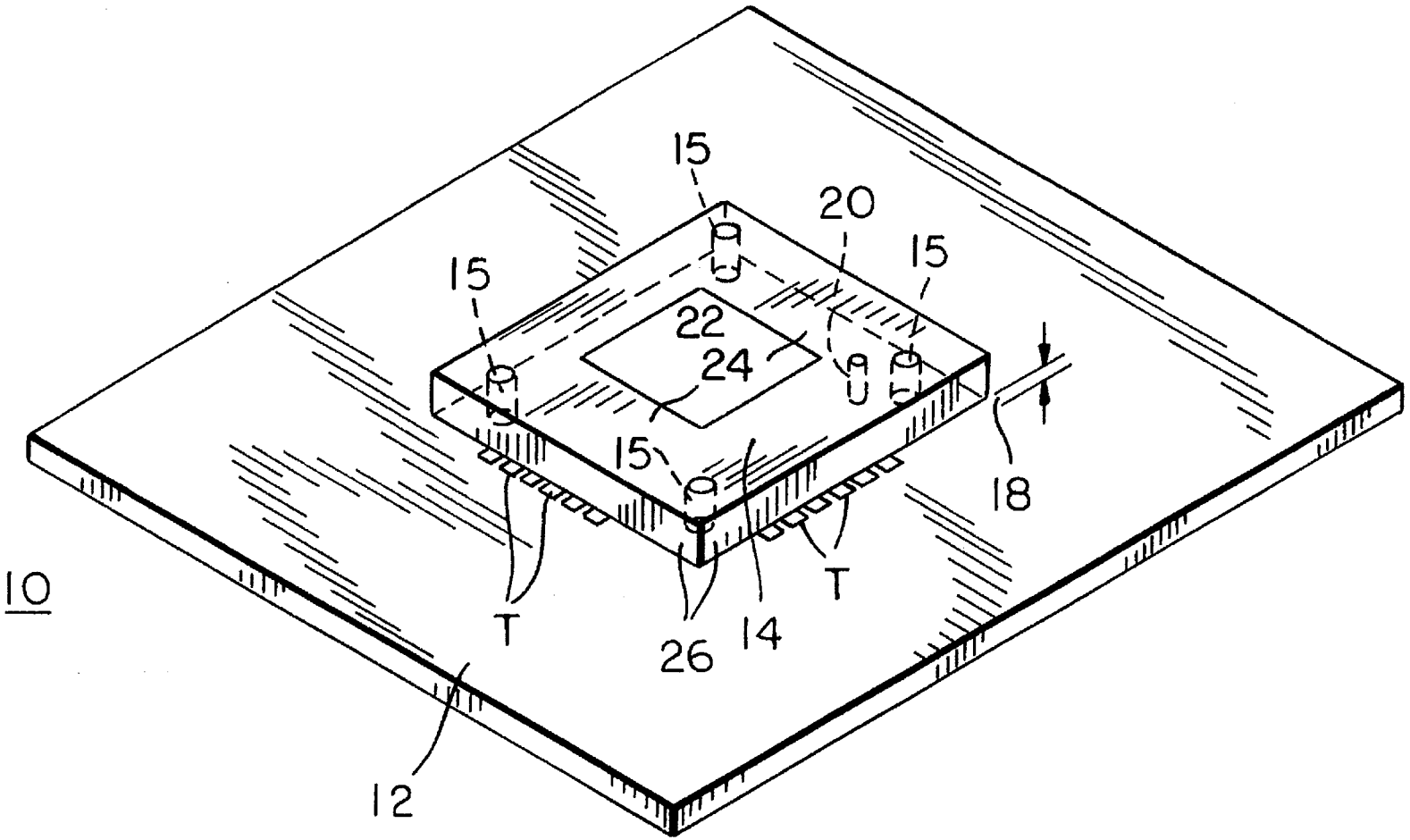
FIG. 1 is a perspective view of an antenna constructed in accordance with the invention.
Figure 2:
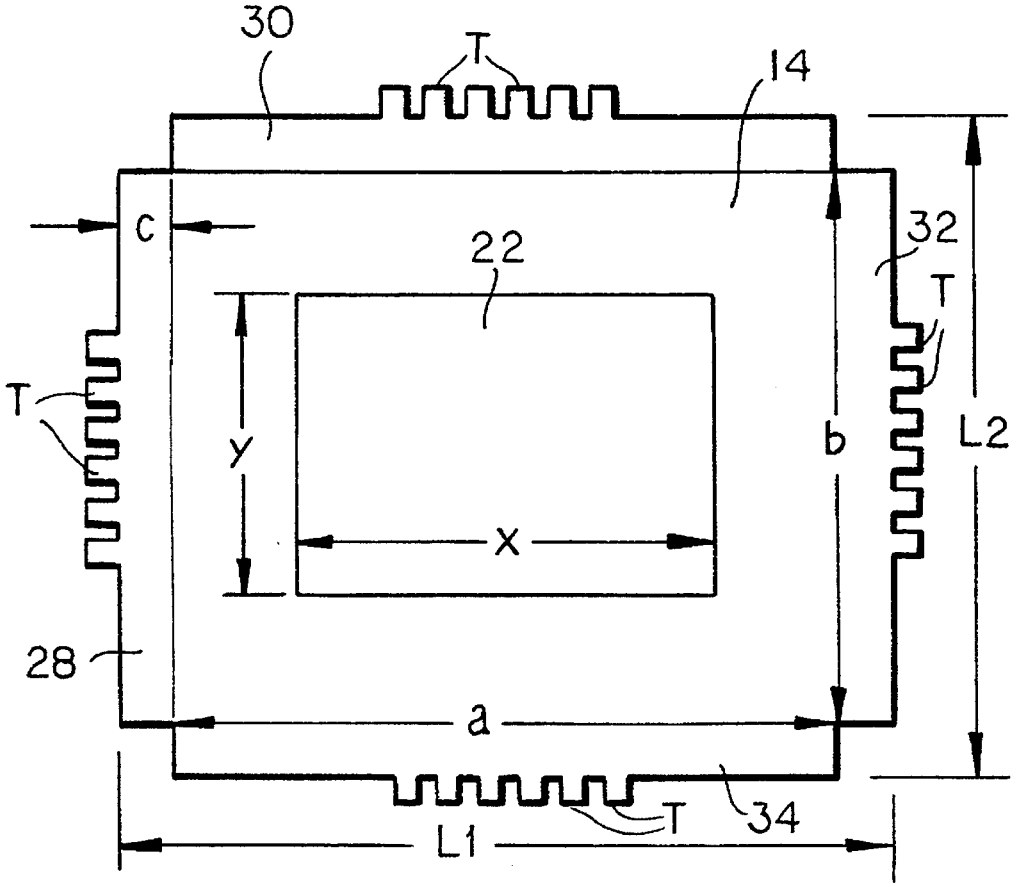
FIG. 2 is a developed plan view of the antenna radiating element.

FIGS. 1 and 2 show an antenna 10 constructed in accordance with the invention. The antenna 10 includes a conductive base that functions as a ground plane 12. A radiating element or patch 14 made of an inexpensive conductive material such as steel, preferably given a protective coating of a material such as nickel, is mounted above the ground plane 12 by insulated standoffs 15. The standoffs 15 can be made of a dielectric plastic such as polyethylene, and they support the antenna 14 at a height such that there is a gap 18 of small dimensions (e.g., 20–30 mils) between the ground plane 12 and the lowest part of the antenna 14. The antenna 14 is thus insulated by air and by the standoffs 15 from the ground plane 12.

An electrically conductive feed 20 feeds electrical energy to the radiating element 14 for radiation therefrom. As those skilled in the art will understand, the radiation is emitted in the gap between the radiating element or patch 14 and the ground plane 12.

In accordance with the invention, the radiating element 14 is constructed so as to lengthen at least one effective electrical dimension of the radiating element relative to a corresponding dimension of an orthogonal projection of the radiating element onto a plane parallel to the ground plane 12. To this end, the radiating element 14 is formed with a cutout 22 and an outer, dependent portion or flange 26, both described below.

FIG. 2 facilitates an understanding of the concept of lengthening an effective electrical dimension of the radiating element 14 relative to a corresponding dimension of an orthogonal projection of the radiating element onto a plane parallel to the ground plane 12. The radiating element 14 has a central plane portion 24 substantially parallel to the ground plane 12 and an outer portion 26 extending towards the ground plane 12 as illustrated in FIG. 1. The outer portion 26 of the radiating element 14 includes depending flanges 28, 30, 32 and 34 collectively forming the outer flange portion 26. As the assembled view of FIG. 1 illustrates, the flanges 28, 30, 32, and 34 constituting the outer portion 26 extend towards, and preferably (though not necessarily) perpendicularly towards, the ground plane 12. The flanges need not be linear but may take any configuration depending from the central plane portion 24 that will satisfy the desired impedance characteristics.

In the developed plan view of FIG. 2, dimensions L1 and L2 are illustrated. The dimension L1 is equal to the sum of dimension a (the long dimension of the top of the radiating element 14) plus twice dimension c (the depth of the depending flange portion 26). Similarly, the dimension L2 is equal to the sum of dimension b (the short dimension of the top of the rectangular radiating element 14) plus twice dimension c (the depending outer flange portion 26 has the same height all around, resulting in a uniform gap 18 all around between the radiating element 14 and the ground plane 12).

An orthogonal projection of the radiating element 14 onto the ground plane or onto any plane parallel to the ground plane has only the dimensions a and b shown in FIG. 2; the dimension c is totally foreshortened.

The cutout 22 has a dimension x parallel to the dimensions L1 and a and a dimension y parallel to the dimensions L2 and b (FIG. 2).

For operation at 1575.42 MHz, the dimensions a, b, c, L1, L2, x and y are preferably as shown in the following table:

| | |
|---|---|
| a | 65.2 mm |
| b | 59.5 mm |
| c | 6.09 mm |
| L1 | 77.38 mm |
| L2 | 71.68 mm |
| x | 24 mm |
| y | 24 mm |

Tuning tabs T, known per se, facilitate tuning to the desired frequency.

In the absence of the cutout, the effective electrical dimension of the radiating element 14 in a direction parallel to the dimension a is equal to L1 (77.38 mm in the example of FIG. 2), and the effective electrical dimension in a direction parallel to the dimension b is equal to L2 (71.68 mm in the example of FIG. 2). Thus even in the absence of the cutout 22, the effective electrical dimension of the radiating element 14 relative to a corresponding dimension of an orthogonal projection of the radiating element onto the ground plane 12 or onto any plane parallel thereto is lengthened.

Moreover, in accordance with the invention, the cutout 22 further lengthens the effective electrical dimensions of the radiating element, since a signal passing between opposite edges of the radiating element 14 is routed around the cutout 22, which of course is nonconducting.

Figure 3:
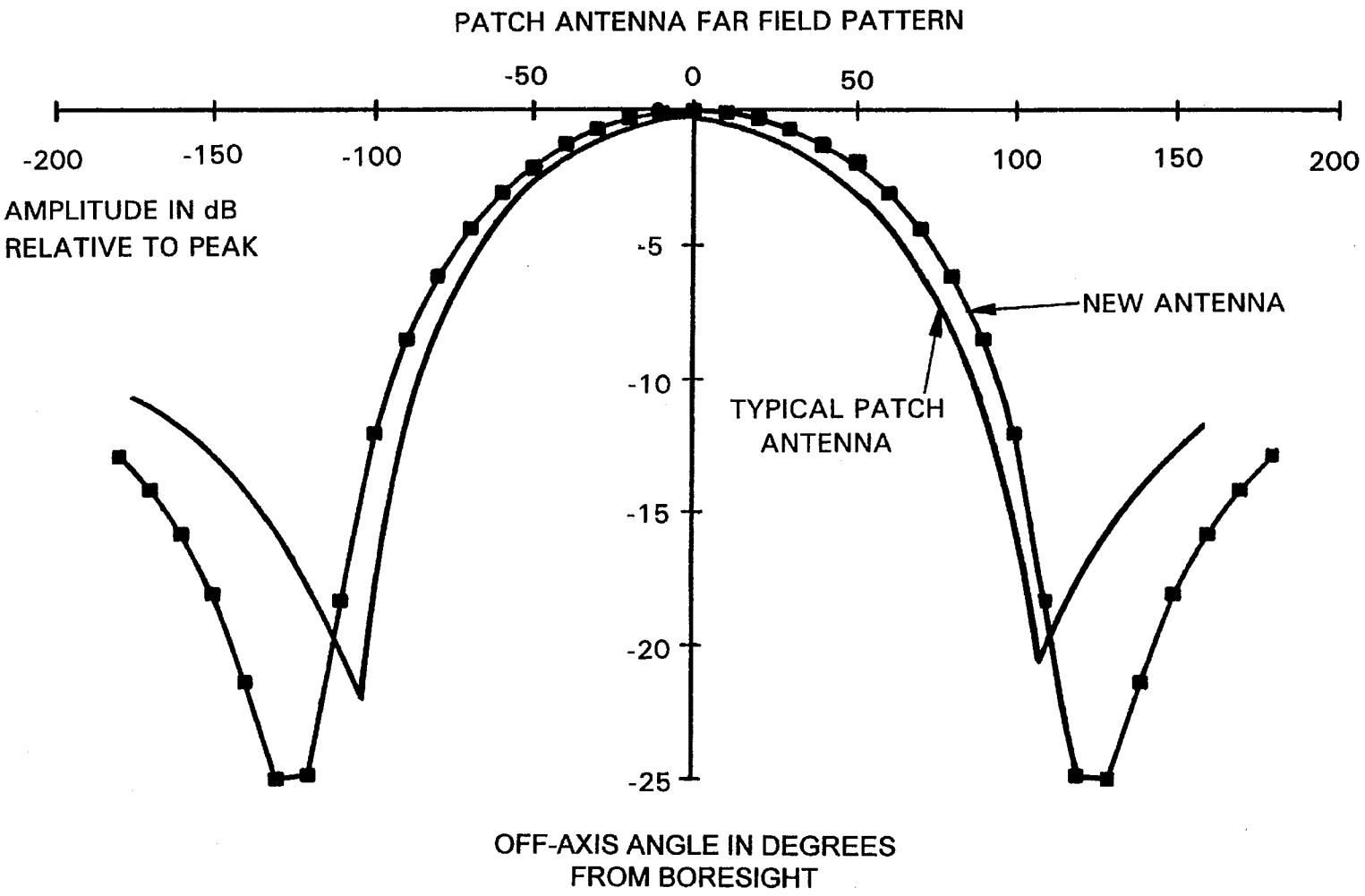
FIG. 3 is a diagram showing certain characteristics of an antenna constructed in accordance with the invention as compared to apparatus of the prior art.

The rectangular shape of the radiating element 14 and the location of the feed 20 for feeding electrical energy are related so that there is a phase angle of 90 ° between radiation in mutually orthogonal directions, which results in circular polarization of the emitted radiation, as those skilled in the art will readily understand. Moreover, the antenna far-field pattern amplitude in dBi relative to peak is improved as shown in FIG. 3 compared to a conventional patch antenna. Specifically, the amplitude is greater in the case of an antenna in accordance with the invention as compared to a conventional patch antenna at angles between the boresight (which extends in a direction normal to the ground plane through the center of the cutout 22) and approximately 110° plus or minus. The angle between the boresight and the zenith is 0° if the antenna is mounted with the ground plane in a horizontal plane. Thus in this situation, a better response in both transmission and reception is achieved. Moreover, a better response is also received if the antenna is mounted for example on a rolling vessel which rolls and/or pitches through an angle of up to about 20° (=110°–90°).

Radiation does not occur through the cutout 22, but the cutout 22, in combination with the depending flange portion 26, substantially lengthens the effective electrical dimensions in relation to the corresponding physical dimensions of the antenna. This makes it possible to employ an antenna which is smaller, lighter, less obtrusive, and less expensive than a conventional patch antenna, as well as being capable of better performance both in transmission and in reception.

Thus there is provided in accordance with the invention a novel and highly effective antenna which attains the objects of the invention as set out above. In particular, since the radiating edges of the antenna of the invention are closer together than those of a conventional plane patch antenna, the far-field radiation pattern of the antenna is made more uniform.

Many modifications of the preferred embodiment of the invention disclosed above will readily occur to those skilled in the art. For example, while the dimensions indicated in the table are preferred dimensions for operation at 1575.42 MHz, the dimensions can be adjusted as will readily be understood by those skilled in the art for optimum performance at other frequencies. Moveover, even at the frequency of 1575.42 MHz, the dimensions can be adjusted to modify the performance of the antenna to provide, for example, polarization that is elliptical but not circular or to modify the performance of the antenna in other ways well understood by those skilled in the art. The ground plane need not be a physical plane as indicated at 12 in FIG. 1 but can be defined by an elevated conductive flange below and extending upward from the base 12 towards the antenna element 14. It is not even necessary that a continuous flange be employed; for example, a series of upstanding conductive posts can be substituted for a continuous upstanding flange. While air is the preferred dielectric in accordance with the invention (in view of the very low cost of manufacture that results), plastic and other dielectrics can be employed, thereby enabling a still further reduction in the size of the antenna.

Many other modifications of the preferred embodiment of the invention disclosed above will readily occur to those skilled in the art. Accordingly, the invention is to be construed as including all structure falling within the scope of the appended claims as well as equivalents thereof.

We claim:

1. An antenna comprising:

means defining a ground plane;

means defining a radiating element having a plane portion substantially parallel to the ground plane and formed with a square nonradiating cutout, the means defining the radiating element also having an outer portion extending towards the ground plane;

means supporting the radiating element in spaced-apart relation to the ground plane so as to be electrically insulated therefrom and so as to define a radiating gap between the outer portion and the ground plane; and feed means for feeding electrical energy to the radiating element for radiation therefrom;

the radiating element therefore having at least one effective electrical dimension that exceeds a corresponding dimension of a projection of the radiating element onto the ground plane along an axis perpendicular to the ground plane.

2. An antenna according to claim 1 wherein the outer portion extends in a direction that is perpendicular to the ground plane.

3. An antenna according to claim 1 wherein the cutout is centered with respect to the plane portion of the radiating element.

4. An antenna according to claim 1 employing air as a dielectric.

5. An antenna according to claim 1 further comprising at least one insulated standoff physically mounting the means defining the radiating element on the means defining the ground plane.

* * * * *